US008485615B2

(12) United States Patent
Ciyanoglu et al.

(10) Patent No.: US 8,485,615 B2
(45) Date of Patent: Jul. 16, 2013

(54) MOUNTING STRUCTURE AND METHOD FOR THE UPRIGHT MOUNTING OF A DECORATIVE PLATE ON A DOOR OF A HOUSEHOLD APPLIANCE

(75) Inventors: Mehmet Ciyanoglu, Giengen (DE); Karl-Friedrich Laible, Langenau (DE); Helmut Steichele, Lauingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 220 days.

(21) Appl. No.: 12/937,374

(22) PCT Filed: Apr. 6, 2009

(86) PCT No.: PCT/EP2009/054084

§ 371 (c)(1),
(2), (4) Date: Oct. 12, 2010

(87) PCT Pub. No.: WO2009/127549

PCT Pub. Date: Oct. 22, 2009

(65) Prior Publication Data

US 2011/0030188 A1 Feb. 10, 2011

(30) Foreign Application Priority Data

Apr. 17, 2008 (DE) ..... 10 2008 019 421

(51) Int. Cl.
*A47B 97/00* (2006.01)

(52) U.S. Cl.
USPC ..... 312/204

(58) Field of Classification Search
USPC ..... 312/204, 405, 265.5, 265.6; 248/316.8, 248/220.22, 223.41, 224.7, 222.12; 24/295, 24/297, 458
See application file for complete search history.

(56) References Cited

U.S. PATENT DOCUMENTS

| | | | | |
|---|---|---|---|---|
| 4,753,406 | A | 6/1988 | Kodama et al. | |
| 5,735,411 | A * | 4/1998 | Flamme et al. | 211/26 |
| 6,364,589 | B1 * | 4/2002 | Wenglinski | 411/508 |
| 8,079,652 | B2 * | 12/2011 | Laible et al. | 312/242 |
| 8,182,051 | B2 * | 5/2012 | Laible et al. | 312/111 |
| 2007/0188059 | A1 * | 8/2007 | Davis et al. | 312/265.6 |
| 2011/0025173 | A1 * | 2/2011 | Ciyanoglu et al. | 312/204 |
| 2011/0030410 | A1 * | 2/2011 | Ciyanoglu et al. | 62/331 |

FOREIGN PATENT DOCUMENTS

| | | | |
|---|---|---|---|
| EP | 0108677 | A1 | 5/1984 |
| EP | 0261083 | A2 | 3/1988 |

* cited by examiner

*Primary Examiner* — Darnell Jayne
*Assistant Examiner* — Matthew Ing
(74) *Attorney, Agent, or Firm* — James E. Howard; Andre Pallapies

(57) ABSTRACT

A mounting to support a decorative plate on a door of a household appliance. The mounting includes a first mounting part to be mounted on the door or the decorative plate, wherein the first mounting part has at least one tongue. The mounting further includes a second mounting part fastened to the respectively other of two holding partners formed by the decorative plate and the door. The second mounting part has a bridging segment to receive the tongue with play in a longitudinal direction of a flank of the door. The second mounting part is configured in the manner of a batten having multiple bridging segments. Each of the bridging segments receives a respective tongue.

25 Claims, 4 Drawing Sheets

Prior Art

Fig. 7
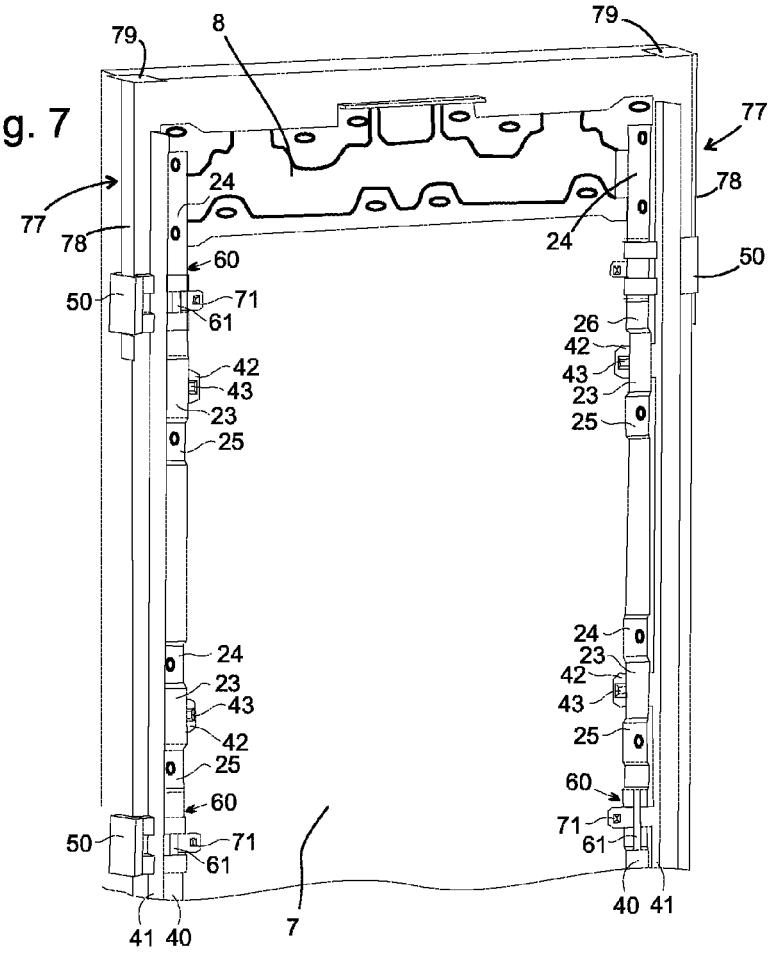
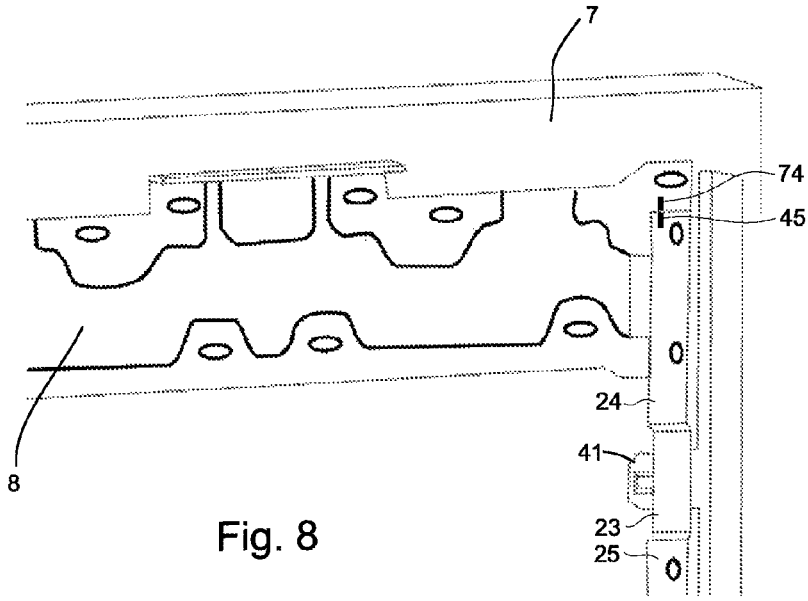
Fig. 8

MOUNTING STRUCTURE AND METHOD FOR THE UPRIGHT MOUNTING OF A DECORATIVE PLATE ON A DOOR OF A HOUSEHOLD APPLIANCE

BACKGROUND OF THE INVENTION

The invention relates to a method and a mounting structure suitable for this for mounting a decorative plate at the correct height on a door of a household appliance.

When household appliances are built into kitchen units or are set up adjacent to these, the configuration of the visible front of the appliance is frequently matched to the décor of the doors of the adjacent kitchen units. To achieve a precisely flush arrangement of the unit doors and the visible parts of the appliance front, the latter are generally made up of a number of parts, specifically a door, which has to be mounted in a defined position in relation to a carcass of the appliance in order to close off an interior of the household appliance, and a decorative plate, which is mounted on the door with the aid of a mounting structure at a later stage when the household appliance is set up in its intended location of deployment and adjusted in relation to adjacent unit fronts.

A mounting structure is known from DE 10 2005 021 607 A1 and shown in FIG. 1. It comprises a plurality of stirrups 14 screwed to the rear face of a decorative plate 7 and mounting elbows 16, which are inserted into passages formed between the stirrups 14 and the decorative plate 7 and screwed to a lateral flank of the door. Vertical play of the mounting elbows 16 in the passages 15 predetermines the freedom of movement for vertical adjustment of the decorative plate 7. Inaccuracies when attaching the stirrups 14 reduce this play undesirably. Adjustment takes place with the aid of positioning screws 12 on an upper flank 3 of the door 2. To ensure a secure hold, these positioning screws 12 are initially screwed in deeper than is ultimately required when the decorative plate has been finally adjusted. The fine adjustment of the screws 11 is time-consuming, since each non-identical alignment of the two screws 11 means that the decorative plate hangs skew and the correct vertical position can only be assessed when the decorative plate 7 is horizontally aligned in the correct manner.

When the decorative plate is mounted with this known mounting structure, the stirrups 14 are first screwed to the decorative plate 7. To ensure that the refrigerator door 2 is not damaged by one of the mounting elbows 16 as the decorative plate 7 is hung, the decorative plate 7 must first be suspended from the door 2 and the mounting elbows 16 are then inserted from the side. As the passages 15 are concealed in a gap between the decorative plate 7 and the door 2 and are not easy to access, it is difficult to insert the mounting elbows 16 into the passages 15 and as the mounting elbows 16 have to be clamped in the passages 15, to prevent the decorative plate 7 rattling, considerable force is required to drive them as deeply as required into the passages 15. Tools, such as a hammer for example, cannot be used due to the risk of damaging the decorative plate 7 or bending the mounting elbows 16.

BRIEF SUMMARY OF THE INVENTION

The object of the invention is to create an adjustable mounting, in particular a mounting structure, which can be mounted quickly and efficiently.

The object is achieved in that in the case of a mounting, in particular a mounting structure to support a decorative plate on the door of a household appliance, having a first mounting part to be mounted on the door or the decorative plate, which features at least one tongue, and a second mounting part to be supported on the respectively other holding partner formed by the decorative plate or the door and featuring a bridging segment to receive the tongue with play in the longitudinal direction of the flank, the second mounting part is configured in the manner of a batten having a multiplicity of bridging segments each receiving one tongue. In this way the distance between the bridging segments after mounting on the decorative plate is determined by the configuration of the second mounting part and independent of any inaccuracies during attachment of the second mounting part.

The first mounting part is preferably provided on a flank of the door, preferably on a lateral flank of the door.

A further step to simplify assembly is that the first mounting part is configured in the manner of a batten and having a multiplicity of tongues according to the number of bridging segments. This further reduces the number of parts to be handled and ensures correct alignment of the tongues and bridging segments of a first and second mounting part in relation to one another.

Considerable simplification can further be achieved in that one of the mounting parts features a connecting tongue which is held with a form fit or friction lock in an intermediate space of the other mounting part. This allows the mounting parts to be joined together before the second mounting part is mounted on the door. The tongues therefore no longer have to be inserted into passages counter to a friction resistance but are already in these, when they result due to the mounting of the second mounting part on the decorative plate.

It is preferably the first mounting part that features the connecting tongue. It is thus possible to realize a friction-locked cohesion of the mounting parts in a simple manner, in that the connecting tongue and the tongues of the first mounting part clamp the second mounting part from different sides. It is not necessary to clamp the tongues between the bridging segments and the decorative plate, even to prevent the decorative plate rattling. The degree of friction occurring between the mounting parts is therefore determined solely by their manufacture, not by how tightly the second mounting part is screwed to the decorative plate.

As an alternative to the connecting tongue held in the intermediate space, preferably in addition to this, a blocking facility can be provided, which in an inactive state permits displacement of the mounting parts in relation to one another—at least in the longitudinal direction, if freedom of movement in the other directions has already been canceled by the connecting tongue—and in an active state holds the mounting parts so that they cannot move in relation to one another.

The blocking facility can in particular be a spacer that can be inserted between the mounting parts, said spacer preferably limiting the play of the mounting parts in opposing directions. It is thus possible, after deactivation of the spacer, preferably by removing it, to allow subsequent adjustment of the decorative plate in both directions.

To facilitate the fastening of the mounting parts to the decorative plate essentially at the correct height, the mounting structure preferably comprises at least one stop-type gage that can be guided in such a manner that it can be adjusted vertically in relation to the first mounting part. This allows the first mounting part with the stop-type gage to be positioned temporarily on the door, the stop-type gage to be aligned in relation to an adjacent decorative plate and the alignment of the stop-type gage then to be taken into account when fastening the second mounting part to the decorative plate.

The stop-type gage is preferably angled with one arm extending preferably vertically in the longitudinal direction and one arm oriented perpendicular thereto, preferably horizontally.

Because the vertical arm is disposed laterally adjacent to a vertical flank of the door, it does not have to fit into a gap between the door and the decorative plate. This gap can therefore be kept narrow, which improves space utilization and/or the freedom of movement for adjustment of the decorative plate in a depthways direction.

The thickness of the horizontal arm preferably corresponds to the gap measurement of a horizontal gap between adjacent decorative plates of a built-in kitchen. Therefore, when the upper face of the horizontal arm is brought to rest against the lower edge of a decorative plate above it, the lower face of the same arm can serve directly as a stop reference for positioning the decorative plate of the household appliance.

To prevent the stop-type gage slipping between coming to rest against the decorative plate above and positioning on the decorative plate of the household appliance, the stop-type gage is expediently fixed by clamping or latching in relation to one of the mounting parts.

The stop-type gage is preferably connected to the first or second mounting part by way of a spacer, in particular the spacer mentioned above, and guided in such a manner that it can be displaced vertically on the spacer. This makes it possible for example to maximize the distance between two stop-type gages disposed on opposing vertical flanks of the door.

In order not to interfere with subsequent use of the household appliance, the spacer is preferably fastened to the first or second mounting part in a detachable manner.

A spacer can serve at the same time as reference for the alignment of the decorative plate in a lateral direction, if it features a first stop surface to rest against an outer edge of the decorative plate and a second stop surface parallel to the first stop surface to rest against the second mounting part.

To simplify the assembly of the first mounting part with the decorative plate, the spacer and the first mounting part preferably feature latching means that interact in a releasable manner to fix the spacer to the first mounting part at least in a direction perpendicular to the stop surfaces. The spacer is preferably made of elastic plastic material or hard rubber, so that it responds in a flexible manner to such a degree that it can be latched by hand without the use of tools and can be unlatched again after the first mounting part has been mounted on the decorative plate.

The fixing of the spacer is also assisted if said spacer preferably features fingers gripping a stirrup of the second mounting part on opposing sides and supporting the second stop surface.

If the fingers of the spacer form two pairs of fingers lying opposite each other on both sides of the stirrup, the connecting tongue expediently engages in an intermediate space between the pairs of fingers. The connecting tongue and the fingers can thus bring about the locking as discussed above, which limits the upward and downward vertical play of the mounting parts in relation to one another.

Two first mounting parts are preferably provided for fastening to opposing vertical flanks of the door. A large distance thus results between the first mounting parts and therefore also between the stop-type gages, reducing the risk of skewed hanging of the decorative plate due to inaccuracies when fastening the mounting parts to the decorative plate and the resulting labor outlay for any subsequent adjustments required.

BRIEF DESCRIPTION OF THE DRAWINGS

Further features and advantages of the invention will emerge from the description which follows of exemplary embodiments with reference to the accompanying figures, in which:

FIG. 7 shows a top view of the rear face of the decorative plate with bridging battens, angled fastening battens and stop-type gages attached thereto; and FIG. 8 shows an enlarged detail from FIG. 7.

DETAILED DESCRIPTION OF EXEMPLARY EMBODIMENTS OF THE PRESENT INVENTION

Figure 1:
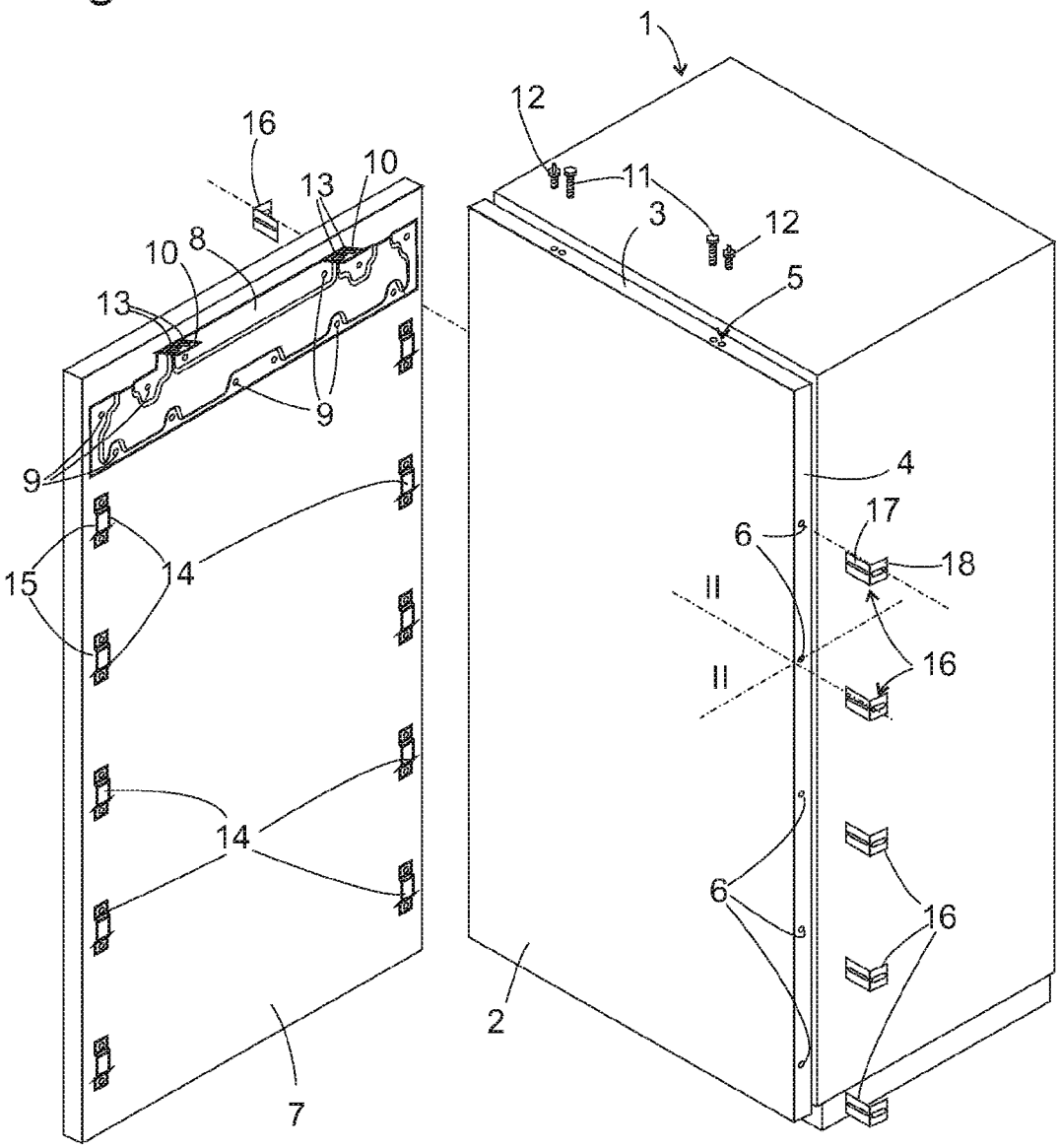
FIG. 1 shows a mounting structure known from the prior art for connecting the door of a household appliance to a decorative plate.

To illustrate the problem underlying the invention FIG. 1 shows a mounting structure known from the prior art for connecting the door of a household appliance to a decorative plate, as described for example in the published German patent application DE 10 2005 021 607 A1. The figure shows the perspective view of a household appliance having a carcass 1 and a door 2 hinged thereto in the closed position. A number of threaded blind holes 5, 6 are formed in an upper flank 3 and the lateral flanks 4 of the door 2.

The decorative plate, which is made of wood for example, is shown separated from the appliance-side door 2, on which it is to be mounted. FIG. 1 shows the rear face of the decorative plate 7, which faces the door 2 in the mounted state. In the upper region of the decorative plate 7 an adjusting rail 8 made of sheet metal is fastened with the aid of a number of screws 9. The adjusting rail 8 has a base plate which is stiffened by a flat rib and rests against the decorative plate 7 and two tabs 10 projecting at right angles from the upper edge of the base plate, each having two openings. These openings serve to fasten the decorative plate 7 to the upper flank 3 of the appliance-side door plate 2 with the aid of screws 11 and 12 respectively. The screws 11 are standard screws with a threaded shank and a head. The screws 12 are special screws with a threaded shank, a head and a pin projecting upward from the head. The screws 11, 12 are dimensioned so that their heads do not fit through the openings 13 in the tabs 10 but their shanks do and in the case of the screw 12, its pin. The two screws 12 are first inserted into their assigned threaded holes 5 then the decorative plate is suspended on the screws 12 in such a manner that their pins engage through their assigned openings 13 and the tabs 10 rest on the heads of the screws 12. The height of the decorative plate 7 can be adjusted by turning the screws 12. The lateral position of the decorative plate 7 and its distance from the appliance-side door 2 can be adjusted by displacing the tabs 10 on the heads of the screws 12. When the correct height of the decorative plate 7 has been found, it can be fixed by tightening the screws 11.

A plurality of stirrups 14 bent from sheet metal are screwed to the rear face of the decorative plate 7 adjacent to its lateral edges, each together with the decorative plate 7 defining a gap 15 that is open to the adjacent edge. The gaps 15 are provided in each instance to accommodate a first arm 17 of a mounting elbow 16 formed from sheet metal like the stirrups 14 with a friction lock, a second arm 18 of said mounting elbow 16 being screwed in each instance to one of the threaded holes 6 of one of the lateral flanks 4 of the door 2.

The provision of five pairs of stirrups 14 and mounting elbows 16 respectively on each face of the door 2 is very demanding for a fitter, since the large number of individual elements always brings with it a risk of confusion, incorrect use or loss. There is also a significant mounting outlay, as mutually flush mounting of the stirrups 14 on the decorative plate 7 requires an extremely precise fitting operation.

Figure 2:
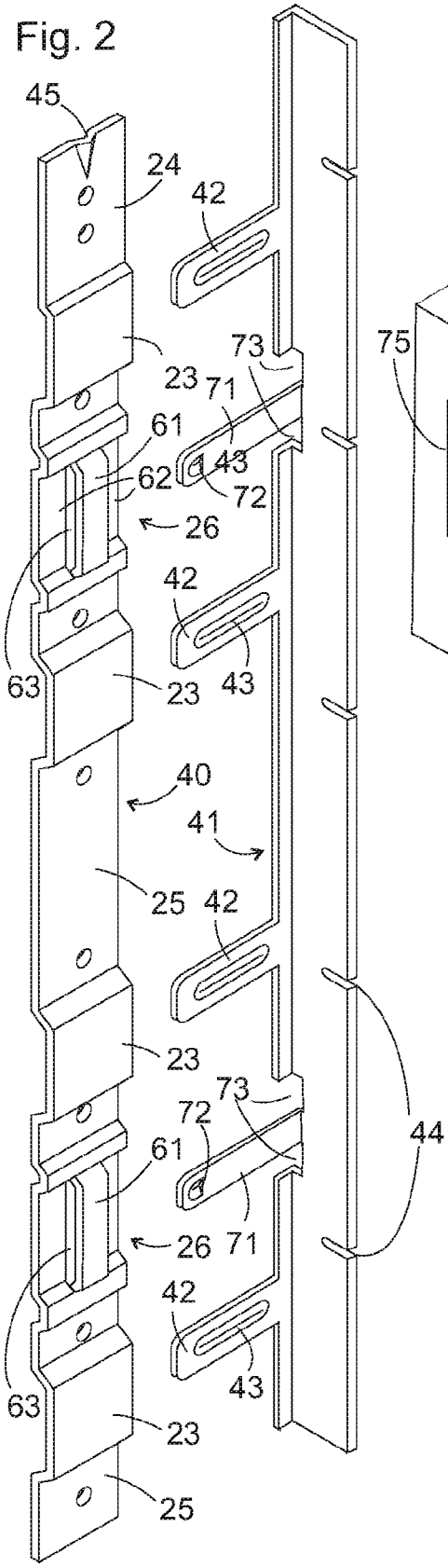
FIG. 2 shows a perspective view of a bridging batten and an angled fastening batten of an inventive mounting structure.

FIG. 2 shows a perspective view (not to scale) of two mounting parts, a bridging batten 40 and an angled fastening batten 41, according to one embodiment of the present invention.

The bridging batten 40 is a metal strip subdivided by a multiplicity of cranked stages, being provided to be screwed to the rear face of the decorative plate 7 adjacent to a lateral edge. Bearing surfaces 24, 25, 26 and bridging segments 23 alternate in the longitudinal direction of the bridging batten, offset from one another by the cranked stages. The bearing surface 24 forming the upper end of the bridging batten 40 is provided to clamp the adjusting rail 8 when it is screwed to the decorative plate 7; the other bearing surfaces 25, 26 are in direct contact with the decorative plate 7. While the bearing surfaces 25 per se are flat, a latching stirrup 61 flanked by peripheral strips 62 is cut respectively out of the bearing surfaces 26 and released. At least two of the bearing surfaces 26 are present on the bridging batten 40.

The angled fastening batten 41 is an angled profile with two mutually orthogonal arms, the first resting against the decorative plate 7 in the mounted state and the second extending along a lateral flank 4 of the door 2. The first arm features a multiplicity of tongues 42, which are provided to engage in the intermediate spaces between the bridging segments 23 and the decorative plate 7, when the bridging batten 40 is fastened to the decorative plate 7, and latching tongues 71, which are provided to engage in an intermediate space spanned by one of the latching stirrups 61. The tongues 42 are stiffened by embossed beads 43.

The latching tongues 71 each have a latching nose 72 at their tip, which is provided to latch, after the latching tongue 71 has been inserted, into an intermediate space 63 defined by one of the latching stirrups 61 and the adjacent peripheral strips 62 behind the outer edge of the peripheral strip 62 facing away from the edge of the decorative plate 7. The length of the latching stirrup 61 and the peripheral strips 62 is essentially greater than the width of the latching tongue 71 so that when the latching tongue 71 alone engages in the intermediate space 63, it can be displaced in the longitudinal direction of the bridging batten 40, i.e. in the vertical direction, when the mounting parts 40, 41 are mounted.

In order to allow the latching tongue 71 with its latching nose 72 to pass through, the intermediate space 63 must be so wide that a simultaneous friction-locked contact of the latching tongue with the stirrup 61 and the peripheral strips 62 is possible when the latching nose 72 passes over the peripheral strips 62 facing away from the edge of the decorative plate 7 but no longer behind its edge once the latching nose 72 is latched in. A friction lock is achieved in that the bridging batten 40 is clamped between the latching tongues 71 on the one hand and the tongues 42 on the other hand. The two mounting parts 40, 41 thus form a manageable unit even before the attachment of the bridging batten 40 to the decorative plate 7.

Slots 44 are provided in the second arm to be pushed onto screws screwed loosely into the side flank 4 of the door 2, and thus to hold the decorative plate 7 with the mounting parts 40, 41 initially loosely on the door 2, in such a manner that it can be adjusted in the depthways direction of the refrigeration appliance.

Figure 3:
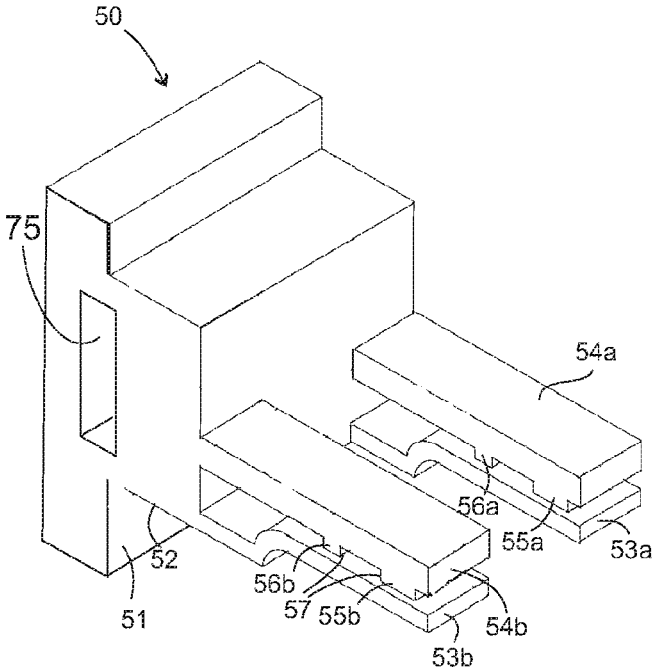
FIG. 3 shows a perspective view of a spacer.
Figure 4:
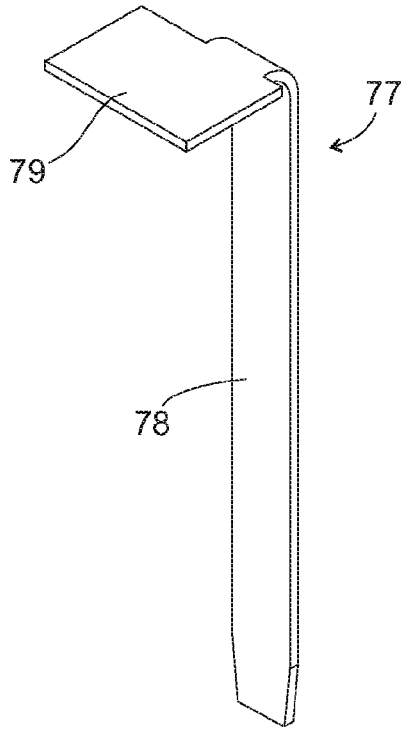
FIG. 4 shows a perspective view of a stop-type gage.

FIG. 3 shows a perspective view of a spacer 50 molded from plastic. The spacer 50 has a base plate with a stop surface 51, which is provided to rest against a lateral edge of the decorative plate 7. A block 52 of the spacer 50 projecting beyond the stop surface 51 has a lower surface when viewed in the perspective in FIG. 3, which in the mounted state rests against the rear face of the decorative plate 7. A passage 75 extending through the block 52 is provided, to receive an arm of an angled stop-type gage 77 as shown in FIG. 4, the function of which is described in more detail below with reference to FIG. 7. The stop-type gage 77 is an angled part made of sheet steel having a longitudinally extended arm 78 to be inserted into the passage and a short arm 79 at right angles thereto. The thickness of the sheet steel corresponds to approximately 3 mm, the normal joint width between adjacent decorative plates of a built-in kitchen.

Figure 5:
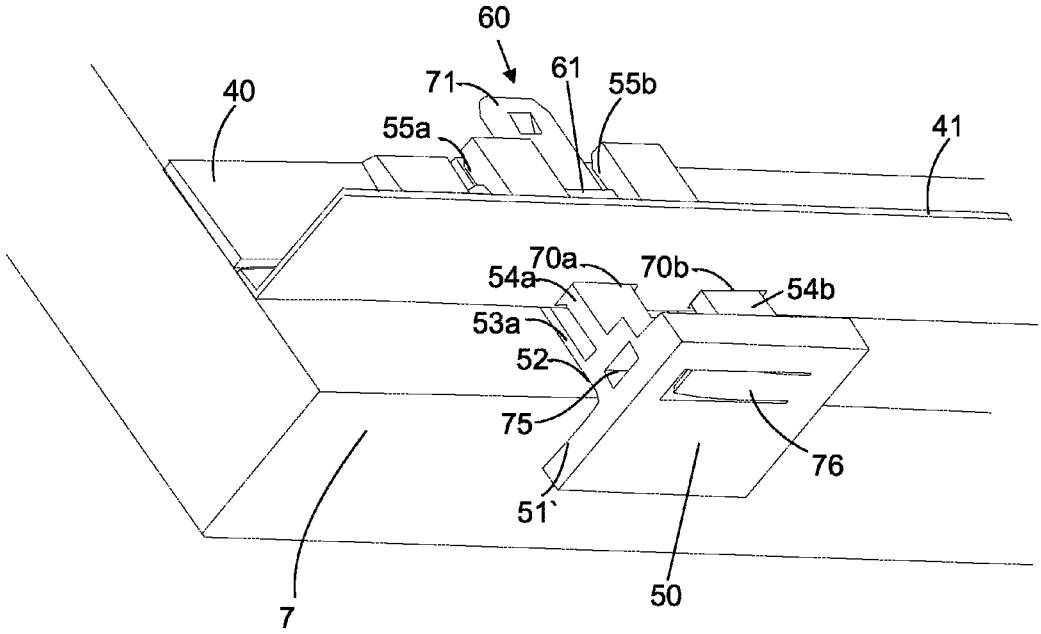
FIG. 5 shows a view of the bridging batten and an angled fastening batten connected together with the aid of the spacer.

An elastic tongue, as shown in FIG. 5, is cut out of the side of the base plate of the spacer 50 away from the observer in FIG. 3 and projects into the passage 75 to clamp the arm 78 of the stop-type gage 77 therein. The outside of the arm 78 can be roughened or ribbed to increase the friction between the arm 78 and the tongue 76 or to allow the arm 78 to latch to the tongue 76 and thus to secure the stop-type gage 77 in an already adjusted position in relation to the spacer 50.

Two pairs of gripping fingers 53*a*, 54*a* and 53*b*, 54*b* respectively project from the block 52, separated from one another by an intermediate space as wide as the latching tongues 71. These gripping fingers extend in the mounted state through cutouts 73 (see FIG. 2) formed in the angled fastening batten 41 on both sides of the latching tongues 71 and engage in the intermediate space 63 above and below the latching tongue 71.

The fingers 53*a*, 53*b* have a cranked profile to facilitate the overcoming of the peripheral strips 62 and insertion into the intermediate space 63.

The gripping fingers 54*a*, 54*b* opposite the fingers 53*a*, 53*b* each have two latching noses 55*a*, 56*a* and 55*b*, 56*b* respectively, which, when the spacer 50 is in the mounted state, grip the latching stirrup 61 on both sides without play. Side flanks of the latching noses 55*a*, 56*a*, 55*b*, 56*b* thus form stop surfaces 57, which determine the distance of the bridging batten 40 from an edge of the decorative plate 7, when the stop surface 51 of the spacer 50 rests against this edge.

With reference to FIG. 2 again, an adjusting mark 45, here in the form of a vertically oriented groove or bead, is embossed at the upper end of the top bearing surface 24. The adjusting rail 8 is provided with complementary adjusting marks 74, the function of which is examined later.

A complete mounting structure for mounting the decorative plate 7 comprises two each of the bridging battens 40 and angled fastening battens 41 shown in FIG. 2, a number of spacers 50 corresponding to the number of latching tongues 71 of the angled fastening battens 41, of which there are at least 4, two stop-type gages 71 and the adjusting rail 8.

A first mounting step is to insert the latching tongues 71 into the intermediate spaces 63 of the bearing surfaces 26, so that the latching noses 72 latch in place on that side of the latching stirrups 61. In this state the bridging battens 40 and the angled fastening battens 41 are connected to one another in a captive manner but can be displaced in relation to one another respectively in their longitudinal direction.

Figure 6:
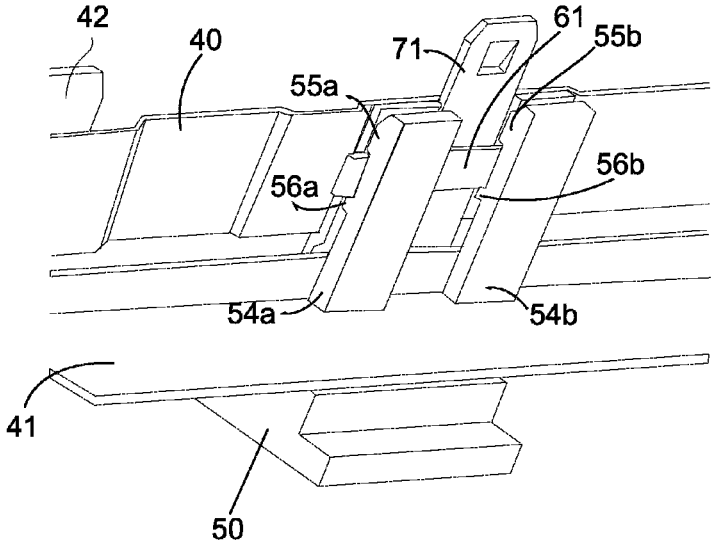
FIG. 6 shows a second view of the connected bridging batten and angled fastening batten.

Next the spacers 50 are inserted respectively with their gripping fingers 53, 54 first through the cutouts 73 on both sides of the latching tongues 71 and into the intermediate space 63 on both sides of one of the latching tongues 71. This also fixes the mounting parts 40, 41 in relation to one another in their longitudinal direction. FIGS. 5 and 6 show two perspective views of the inserted spacer 50.

In each of the modules obtained in this manner from a bridging batten 40 and an angled fastening batten 41 respectively a stop-type gage 77 is inserted into the passage 75 of the spacer 50 next adjacent to the bearing surface 24. The modules are then positioned temporarily on the door 2, in that the slots 44 of the angled fastening batten 41 are pushed onto screws screwed into the side flank 4 of the door 2. In the next step the stop-type gages 77 are pushed upward, until their horizontal arms 79 come to rest against the lower edge of a decorative plate defining the recess into which the household appliance is to be built in an upward direction.

Next the adjusting rail 8 is laid on the upper rear face of the decorative plate 7, which is positioned flat on a base. The two mirror-image modules, each comprising a bridging batten 40, an angled fastening batten 41, a stop-type gage 77 and two spacers 50, are also laid on the rear face of the decorative plate 7 along its side edges, as shown in FIG. 7, the upper bearing surfaces 24 of the bridging battens 40 coming to rest respectively on the adjusting rail 8. Because the lower faces of the horizontal arms 79 of the stop-type gages 77 are brought into contact with an upper edge of the decorative plate, the decorative plate 7 is pre-aligned in a vertical direction in relation to the door 2. Also because the stop surfaces 51 of the spacers 50 are brought into contact with the edges of the decorative plate 7, the two modules are aligned as mirror images of one other at the same distance from the side edges of the decorative plate 7. It is now possible to start screwing the bridging battens 40 to the decorative plate 7 at the level of the bearing surfaces 25, 26. Before the bridging battens are also screwed to the bearing surfaces 24, the adjusting rail 8, which can still be moved at this point, is aligned with the aid of the adjusting marks 45, 74 so that each adjusting mark 74 on the adjusting rail 8 is a direct extension of the adjusting mark 45 on one of the bridging battens 40. This is shown in the enlarged partial top view of the decorative plate 7 in FIG. 8.

As the screws are tightened at the level of the bearing surfaces 24, the adjusting rail 8 is also fixed by being clamped between the bearing surfaces 24 and the decorative plate 7.

In the resulting module made up of the decorative plate 7, mounting parts 8, 40, 41 and spacers 50, all the parts are fixed in relation to one another. At this stage the complete module can be suspended temporarily on the door 2, by pushing the slots 44 of the angled fastening battens 41 onto screws screwed into the side flanks 4 of the door and positioning the adjusting rail 8 on screws 12 screwed into the upper flank of the door as described in relation to FIG. 1. At this point the screws 12 can be screwed in up to the stop in the door 2, since the level at which the decorative plate 7 is held on the door 2 is determined by the mounting parts 40 and 41, which are fixed to one another in such a manner that they cannot be moved vertically by the spacers 50.

It is now possible to adjust the position of the decorative plate 7 directly in the depthways direction and then tighten the screws in the side flanks 4 of the door 2; it is also possible to tighten the screws temporarily first and perform a depthways adjustment at a later time.

After the angled fastening battens 41 have been fixed to the side flanks 4 by tightening the screws, the screws 12 are adjusted so that they press against the adjusting rail 8 and can support the weight of the decorative plate 7. The spacers 50 and along with them the stop-type gages 77 are then removed. Withdrawal of the spacers 50 means that the decorative plate 7 can be adjusted vertically again. Since the bridging battens 40 are clamped between the tongues 42 and the latching tongues 71 of the angled fastening battens 41, the decorative plate 7 is held without play in a depthways direction and cannot rattle either now or after mounting is completed. Since however the tongues 42 are not clamped in the passages defined on the one hand by the bridging segments 23 and on the other hand by the decorative plate, easy adjustment is possible in the vertical direction and also in the widthways direction.

Fine vertical adjustment can now performed with the aid of the screws 12 if required. When the decorative plate 7 is aligned correctly in a vertical direction, it is fixed with the aid of the screws 11, as described with reference to FIG. 1.

The invention claimed is:

1. A mounting for supporting a decorative plate on a door of a household appliance, the mounting comprising:

a first mounting part to be mounted on one of the door and the decorative plate, the first mounting part having at least one tongue; and a second mounting part fastened to the respectively other of the one of the door and the decorative plate, the second mounting part having a bridging segment to receive the at least one tongue with play in a longitudinal direction of a flank of the door;

wherein the second mounting part is configured in the manner of a first batten that has a plurality of bridging segments, each of the plurality of bridging segments receiving a respective tongue, wherein the first mounting part has a connecting tongue, and wherein the connecting tongue and a plurality of tongues clamp the second mounting part from different sides.

2. The mounting of claim 1, wherein the first mounting part is supported on the flank of the door, and wherein the second mounting part is supported on the decorative plate.

3. The mounting of claim 1, wherein the first mounting part is configured in the manner of a second batten that has a plurality of tongues.

4. The mounting of claim 1, wherein one of the first and second mounting parts has a connecting tongue, which is held with at least one of a form fit and a friction lock in an intermediate space of the other of the first and second mounting parts.

5. A household appliance, comprising:

a door;

a decorative plate supported in front of the door; and a mounting to hold the decorative plate on the door, the mounting comprising:

a first mounting part to be mounted on one of the door and the decorative plate, the first mounting part having at least one tongue; and a second mounting part fastened to the respectively other of the one of the door and the decorative plate, the second mounting part having a bridging segment to receive the at least one tongue with play in a longitudinal direction of a flank of the door;

wherein the second mounting part is configured in the manner of a first batten that has a plurality of bridging segments, each of the plurality of bridging segments receiving a respective tongue, wherein the first mounting part has a connecting tongue, and wherein the connecting tongue and a plurality of tongues clamp the second mounting part from different sides.

6. The household appliance of claim 5, wherein the household appliance is a household refrigeration appliance.

7. A method for mounting a decorative plate on a door of a household appliance by means of a mounting, the mounting having a first mounting part to be mounted on one of the door and the decorative plate, the first mounting part having at least one tongue, and a second mounting part fastened to the respectively other of the one of the door and the decorative plate, the second mounting part having a bridging segment to receive the at least one tongue with play in a longitudinal direction of a flank of the door, wherein the second mounting part is configured in the manner of a first batten that has a plurality of bridging segments, each of the plurality of bridging segments receiving a respective tongue, wherein the first mounting part has a connecting tongue, and wherein the connecting tongue and a plurality of tongues clamp the second mounting part from different sides, the method comprising:

joining together the first and second mounting parts; fastening the second mounting part to the decorative plate; and mounting the decorative plate with the joined first and second mounting parts on the door.

8. The method of claim 7, wherein, in the joining step, the first and second mounting parts are fixed in relation to one another by a spacer, and wherein, after the mounting step, the spacer is removed.

9. A mounting for supporting a decorative plate on a door of a household appliance, the mounting comprising:

a first mounting part to be mounted on one of the door and the decorative plate, the first mounting part having a tongue;

a second mounting part fastened to the respectively other of the one of the door and the decorative plate, the second mounting part having a bridging segment to receive the tongue with play in a longitudinal direction of a flank of the door; and a blocking facility, which, in an inactive state, permits displacement of the first and second mounting parts in relation to one another at least in a longitudinal direction, and which, in an active state, holds the first and second mounting parts so that the first and second mounting parts do not move vertically in relation to one another.

10. The mounting of claim 9, wherein the blocking facility is a spacer that is inserted between the first and second mounting parts.

11. The mounting of claim 10, wherein the spacer limits a play of the first and second mounting parts in opposite directions.

12. A household appliance, comprising:

a door;

a decorative plate supported on the door;

a mounting to hold the decorative plate on the door, the mounting comprising:

a first mounting part to be mounted on one of the door and the decorative plate, the first mounting part having a tongue;

a second mounting part fastened to the respectively other of the one of the door and the decorative plate, the second mounting part having a bridging segment to receive the tongue with play in a longitudinal direction of a flank of the door; and a blocking facility, which, in an inactive state, permits displacement of the first and second mounting parts in relation to one another at least in a longitudinal direction, and which, in an active state, holds the first and second mounting parts so that the first and second mounting parts do not move vertically in relation to one another.

13. A mounting for supporting a decorative plate on a door of a household appliance, the mounting comprising:

a first mounting part to be mounted on one of the door and the decorative plate, the first mounting part having a tongue;

a second mounting part fastened to the respectively other of the one of the door and the decorative plate, the second mounting part having a bridging segment to receive the tongue with play in a longitudinal direction of a flank of the door; and at least one stop-type gage that is guided such that the at least one stop-type gage is adjusted in a longitudinal direction in relation to the first and second mounting parts.

14. The mounting of claim 13, wherein the stop-type gage is angled with one arm oriented in the longitudinal direction and one transversely oriented arm.

15. The mounting of claim 14, wherein the thickness of the transversely oriented arm corresponds to a gap measurement of a gap between adjacent decorative plates of a built-in kitchen.

16. The mounting of claim 13, wherein the stop-type gage is fixed by one of clamping and latching in relation to one of the first and second mounting parts.

17. The mounting of claim 13, wherein the stop-type gage is connected to one of the first and second mounting parts by a spacer, and wherein the stop-type gage is guided such that the stop-type gage is displaced in a longitudinal direction on the spacer.

18. The mounting of claim 17, wherein the spacer is detachably fastened to one of the first and second mounting parts.

19. The mounting of claim 18, wherein the spacer has a first stop surface to rest against an outer edge of the decorative plate and a second stop surface parallel to the first stop surface to rest against the second mounting part.

20. The mounting of claim 19, wherein the spacer and the second mounting part have latching means that interact in a releasable manner to fix the spacer to the second mounting part at least in a direction perpendicular to the first and second stop surfaces.

21. The mounting of claim 20, wherein the spacer has fingers gripping a stirrup of the second mounting part on opposing sides and supporting the second stop surface.

22. The mounting of claim 21, wherein the fingers of the spacer form two pairs of fingers lying opposite each other on both sides of the stirrup, and wherein two of the fingers engage in an intermediate space on both sides of a connecting tongue.

23. A household appliance, comprising:

a door;

a decorative plate supported on the door;

a mounting to hold the decorative plate on the door, the mounting comprising:

a first mounting part to be mounted on one of the door and the decorative plate, the first mounting part having a plurality of tongues;

a second mounting part fastened to the respectively other of the one of the door and the decorative plate, the second mounting part having a plurality of bridging segments, each of the bridging segments to receive a respective tongue with play in a longitudinal direction of a flank of the door; and at least one stop-type gage that is guided such that the at least one stop-type gage is adjusted in a longitudinal direction in relation to the first and second mounting parts.

24. A mounting for supporting a decorative plate on a door of a household appliance, the mounting comprising:

a first mounting part to be mounted on one of the door and the decorative plate, the first mounting part having a plurality of tongues; and a second mounting part fastened to the respectively other of the one of the door and the decorative plate, the second mounting part having a plurality of bridging segments, each of the bridging segments to receive a respective tongue with play in a longitudinal direction of a flank of the door, wherein two first mounting parts are provided for fastening to opposing vertical flanks of the door.

25. A household appliance, comprising:

a door;

a decorative plate supported on the door;

a mounting to hold the decorative plate on the door, the mounting comprising:

a first mounting part to be mounted on one of the door and the decorative plate, the first mounting part having a tongue; and a second mounting part fastened to the respectively other of the one of the door and the decorative plate, the second mounting part having a bridging segment to receive the tongue with play in a longitudinal direction of a flank of the door, wherein two first mounting parts are provided for fastening to opposing vertical flanks of the door.

* * * * *